US005433045A

United States Patent [19]

Yano et al.

[11] Patent Number: 5,433,045

[45] Date of Patent: Jul. 18, 1995

[54] VERTICAL VIBRATION CONTROL DEVICE

[75] Inventors: Kenichi Yano, Chofu; Hideo Hayashi, Tokyo; Ryuichi Kamimura, Tokyo; Masamitsu Miyamura, Tokyo; Jun Matsushima, Tokyo; Toru Kasai, Tokyo; Katsuhisa Kanda, Tokyo; Nobumitsu Funaki, Tokyo, all of Japan

[73] Assignees: Kajima Corporation; Yacmo Kabushiki Kaisha, both of Tokyo, Japan

[21] Appl. No.: 215,179

[22] Filed: Mar. 21, 1994

Related U.S. Application Data

[62] Division of Ser. No. 922,176, Jul. 30, 1992, Pat. No. 5,327,692.

[30] Foreign Application Priority Data

Aug. 1, 1991 [JP] Japan ..... 3-193155
Aug. 7, 1991 [JP] Japan ..... 3-70543

[51] Int. Cl.[6] ..... E04H 9/02

[52] U.S. Cl. ..... 52/167.4; 52/167.7; 248/581

[58] Field of Search ..... 52/167 RM, 167 R, 167 DF, 52/167 AE, 167 E; 248/562, 636, 581, 589, 602

[56] References Cited

U.S. PATENT DOCUMENTS

| | | | |
|---|---|---|---|
| 4,258,516 | 3/1981 | Mori et al. | 52/167 E |
| 4,527,365 | 7/1985 | Yoshizawa et al. | 52/167 EA |
| 4,593,501 | 6/1986 | Delfosse | 52/167 EA |
| 5,129,232 | 7/1992 | Minas et al. | 248/636 |

FOREIGN PATENT DOCUMENTS

| | | | |
|---|---|---|---|
| 0049028 | 3/1986 | Japan | 52/167 EA |

*Primary Examiner*—Carl D. Friedman
*Assistant Examiner*—Kien T. Nguyen
*Attorney, Agent, or Firm*—James H. Tilberry

[57] ABSTRACT

A device to control vertical vibration of a building caused by seismic disturbance. Air springs are positioned and secured between the building foundation and the building superstructure to attenuate vertical vibration of the building. Vertical support rails are secured to the foundation and/or to the building superstructure on opposite sides of, and adjacent to, the air springs. Horizontal connecting brackets are rigidly secured to the air springs and slidably secured to the adjacent rails. The brackets restrain horizontal deflection of the air springs without interfering with vertical reciprocation of the air springs.

7 Claims, 3 Drawing Sheets

VERTICAL VIBRATION CONTROL DEVICE

This application is a division of application Ser. No. 07/922,176, filed Jul. 30, 1992 now U.S. Pat. No. 5,327,892.

BACKGROUND OF THE INVENTION

1. Field of the Invention

The field of the invention comprises, in general, devices which control vibration of buildings caused by seismic disturbances. In particular, the field of invention relates to air spring devices adapted to dampen vertical vibrations in buildings.

2. Description of the Prior Art

In order to protect a building from horizontal vibration, it is known to isolate the building superstructure from its base slab or foundation by interposing rolling members therebetween to permit the building superstructure to shift horizontally relative to its slab or foundation, thereby dissipating the energy of seismic vibration.

Since the average earthquake is mainly characterized by horizontal vibrations, the above-described isolation device can substantially cope with horizontal seismic shock. However, in the case of a large-scale structure located at the epicenter of an earthquake, it is quite possible that the structure will experience vertical, as well as horizontal vibrations, which, if not controlled, could cause structural damage.

Vertical vibration control devices are generally known in the prior art, comprising vertically-expanding air springs. However, prior art vertically expanding and contracting air springs possess little inherent capability to resist horizontal deflection. As a consequence, when a structure is subjected to both horizontal and vertical vibrations, a rocking, or similar, very unstable motion results that renders the air springs ineffective to control vertical vibration. Air springs are comprised of telescoping canisters. The greater the overlap of canister side walls, the greater is the resistance to lateral deflection. However, as the resistance to lateral deflection is increased, the capacity of the air spring to dampen vertical vibrations is decreased.

SUMMARY OF THE INVENTION

The present invention has been proposed in view of the above-discussed limitations of prior art vertical vibration control devices. The primary purpose of the present invention is to provide a vertical vibration control device which is reinforced against horizontal deflection so that the device will function efficiently in response to seismic vertical vibration. To attain this objective, the subject inventive control device comprises an air spring placed between a foundation and a superstructure. An upper support is fixed to the superstructure so as to support an upper end of the air spring, and a lower support is fixed to the foundation so as to support a lower end of the air spring. Guide means are positioned on opposite sides of the air spring to guide the vertical motion of the air spring.

In one preferred embodiment of the invention, the guide means include vertically extending guide rails on opposite sides of the air spring and integrally secured to the lower support. A guide block, slidably engaged with the guide rail, is fixed to a movable part of the air spring through an elastic coupling.

In another preferred embodiment of the invention, the guide portion includes a peripheral collar secured about the external telescoping cylinder of the air spring. Supporting guide means are secured to and project downwardly from the upper air spring support for slidable guiding engagement with the peripheral collar.

In this manner, according to the present invention, the air spring is designed to smoothly respond only to the vertical motion of the superstructure, that is, only for the vertical vibrations, wherein the horizontal motion of the air spring can be acceptably restricted by means of the constraints of the guide portions.

OBJECT OF THE INVENTION

It is the primary object of the present invention to provide a vertical vibration control device which is reinforced against horizontal deflection.

BRIEF DESCRIPTION OF THE DRAWINGS

The foregoing and other objects and features of the invention will become apparent from the following description of preferred embodiments of the invention with reference to the accompanying drawings, in which.

DETAILED DESCRIPTION OF THE PREFERRED EMBODIMENTS

Figure 1:
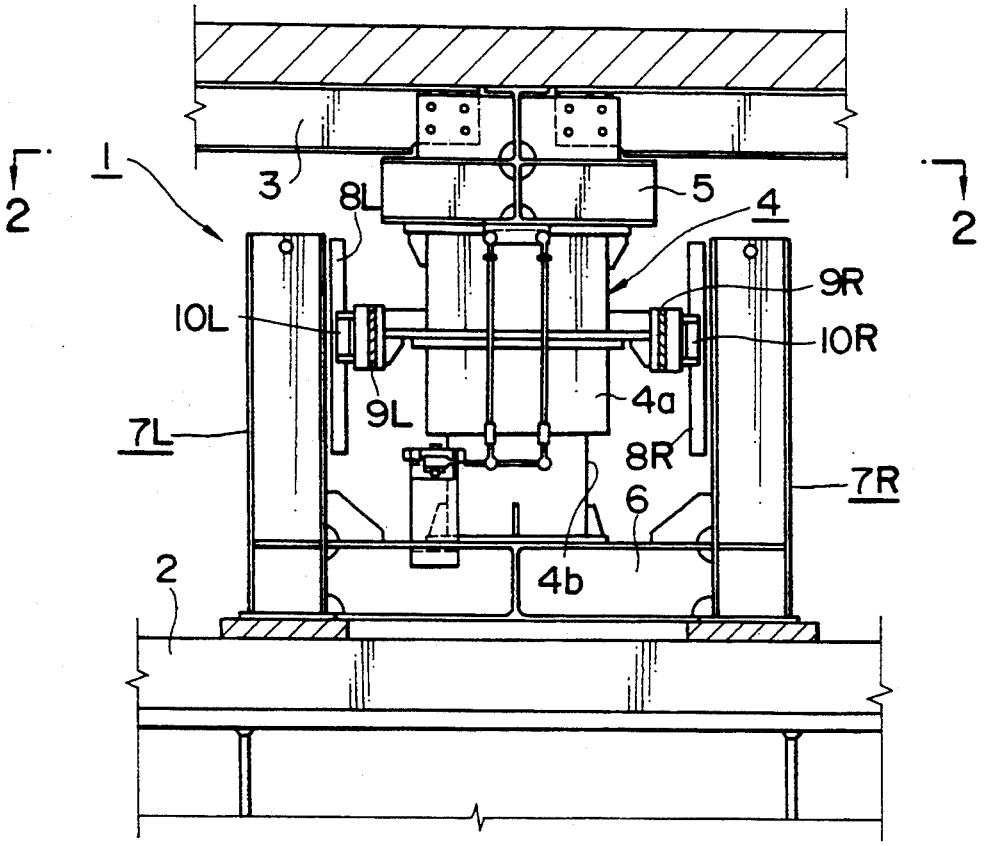
FIG. 1 is an elevational view, partially in section, showing a vertical vibration control device as a first preferred embodiment of the present invention.
Figure 2:
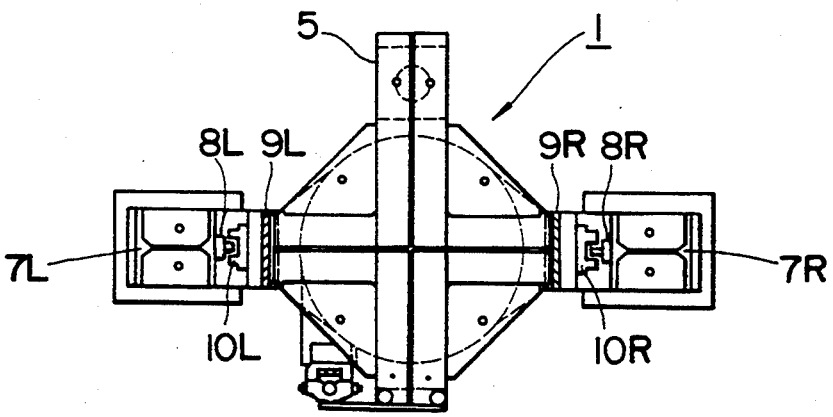
FIG. 2 is a cross-sectional plan view taken along the line 2—2 of FIG. 1.

Referring now to FIGS. 1 and 2, showing a first preferred embodiment of the subject invention, a vibration control device 1 is positioned between a foundation 2 and a superstructure 3. The vibration control device 1 comprises an air spring 4 provided between the foundation 2 and the superstructure 3 and is made of telescoping cylinders comprising an external cylinder **4*a* and an internal cylinder 4*b*, an upper support spacer 5 fixed to the superstructure 3 to support an upper end of the air spring 4, a lower support 6 fixed to the foundation 2 to support a lower end of the air spring 4, and guide means 7L and 7R for guiding the vertical motion of the air spring 4 and restricting horizontal deflection of the air spring 4**.

The vibration control device 1 of FIG. 1 has the guide rails 7L and 7R disposed on opposite sides of the air spring 4, secured to and extending vertically from the lower support 6. Guide rails 7L and 7R include vertically extending guide bars 8L and 8R secured thereto. Guide blocks 10L and 10R are slidably engaged with guide bars 8L and 8R, respectively, and are also fixed to a movable part of the air spring 4 through elastic couplings 9L and 9R.

The guide rails 7L and 7R in this embodiment are made of H-section structural steel members, or the like. The elastic couplings 9L and 9R inserted between the guide blocks 10L and 10R and the movable part of the air spring 4 absorb deflection by deforming when a horizontal force is applied to the air spring 4, so that the guide bars 8 and the guide blocks 10 are maintained in slidable alignment. Thus, the air spring 4 of the vibration control device 1 is restrained from horizontal deflection but is unrestrained for vertical movement.

Figure 3:
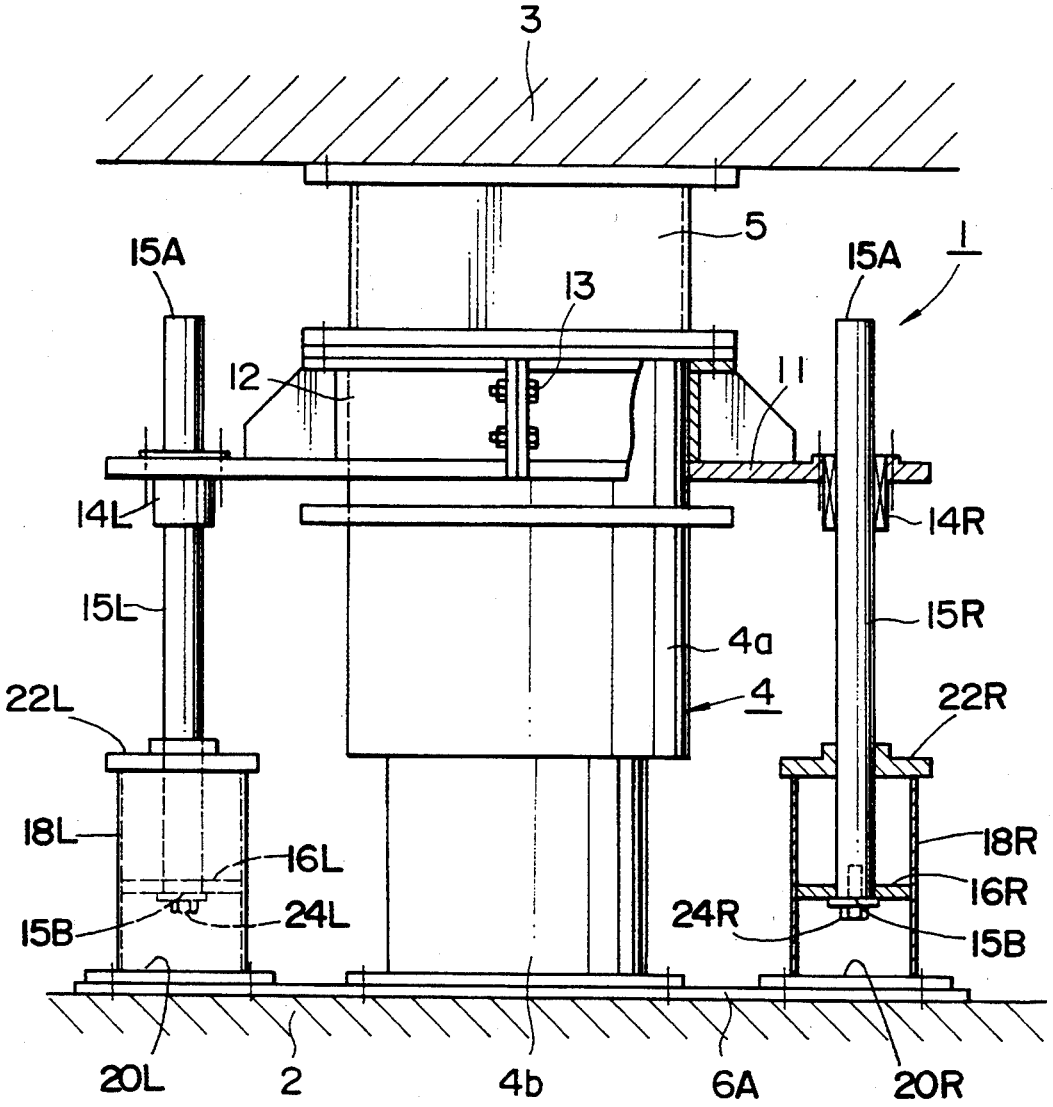
FIG. 3 is an elevational view, partially in section, showing a vertical vibration control device as a second preferred embodiment of the present invention.

FIG. 3 discloses a second preferred embodiment of the invention, wherein like numerals identify like parts. Reference numeral 2 in FIG. 3 identifies a foundation such as the concrete frame of a building vibrated by an earthquake or the like, and numeral 3 identifies a superstructure such as a base-isolation slab completely separated from the foundation 2 so as to isolate the superstructure 3 from vibration. The air spring 4 is provided between the foundation 2 and the superstructure 3 and is made of telescoping cylindrical casings comprising an external cylinder 4*a* and an internal cylinder 4*b* slidably interconnected.

The lower end of the internal cylinder 4*b* is fixed to the foundation 2 by means of bolts or the like. A height adjusting upper support spacer 5 is secured between the upper end of the external cylinder 4*a* and the superstructure 3. In this manner, the superstructure 3 is supported on the foundation 2 through the air spring 4 and the upper support 5.

A segmented collar 12 having a radially projecting horizontal flange portion 11 is attached to the periphery of the external cylinder 4*a* of the air spring 4. The collar 12 is comprised of a pair of semi-circular segments fitted to the periphery of the external cylinder 4*a* by bolts 13. The horizontal flange portion 11 is provided with bearings 14L and 14R as vertical through holes to receive therethrough shafts 15L and 15R, respectively, for sliding engagement.

The shafts 15 and the internal cylinder 4*b* are secured normal to the foundation 2 by means of a connecting lower support plate 6. The shafts 15 are erected in parallel with, and on opposite sides of, the air spring 4. In this manner, when the foundation 2 is vibrated vertically by an earthquake or the like, the vertical vibration is absorbed by the variations in relative positions between the external cylinder 4*a* and the internal cylinder 4*b*, so that the vertical vibration transmitted to the superstructure 3 is minimal.

The external cylinder 4*a* is restrained to move only in a vertical direction, i.e., in the direction of the shafts 15, since the segmented collar 12, fixedly attached to the external cylinder 4*a*, is guided by the shafts 15. The upper support spacer 5 provides adequate clearance between superstructure 3 and the upper end portions 15A of the shafts 15L and 15R so that no impact will occur therebetween.

Figure 4:
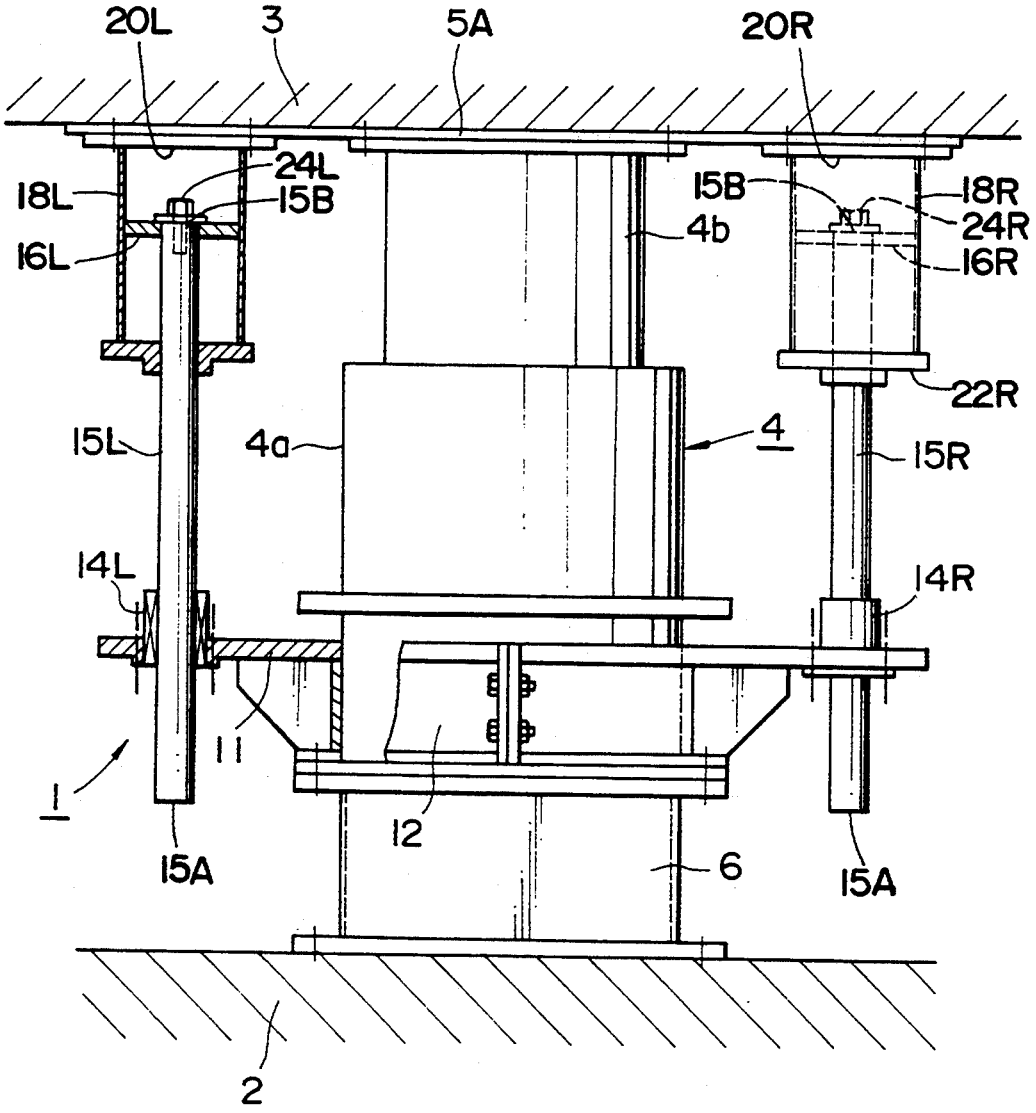
FIG. 4 is an elevational view, partially in section, showing a vertical vibration control device as a third preferred embodiment of the present invention.

The third preferred embodiment of the subject invention is shown in FIG. 4, wherein, it will be noted, shafts 15 are secured normal to the superstructure 3, which is the reverse of the embodiment of FIG. 3. Thus, the lower end of the external cylinder 4*a* of the air spring 4 is fixed to the foundation 2 through the lower support and spacer height adjusting pedestal 6, so that the superstructure 3 is supported at the upper end of the internal cylinder 4*b* of the air spring 4. The segmented collar 12 is fitted with bearings 14 in its horizontal flange portion 11, so as to provide sliding engagement with shafts 15. The third embodiment of the subject invention is, in every respect, an inversion of the embodiment of FIG. 3, and functions in a similar manner.

It will be noted that in FIG. 3 pipe stubs 18L and 18R are secured to plates 20L and 20R, which are secured to lower support plate 6A. The lower portions of shafts 15L and 15R are vertically aligned and secured in pipe stubs 18L and 18R, respectively, by upper pipe caps 22L and 22R and disc plates 16L and 16R secured to the interiors of pipe stubs 18L and 18R, respectively. Ends 15B of shafts 15 may be secured to disc plates 16 by any fastening means well understood by those skilled in the art, such as by threaded fastening means 24L and 24R. The upper portions of shafts 15L and 15R are vertically aligned and stabilized by bearings 14L and 14R which reciprocate on shafts 15L and 15R responsive to vertical movement of segmented collar 12.

The essential difference between the embodiment of FIG. 3 and the embodiment of FIG. 4 is that plates 20L and 20R of FIG. 4 are secured to upper support plate 5A rather than to lower support plate 6A. Otherwise, the segmented collar 12, bearings 14, rods 15, disc plates 16, and pipe stubs 18 provide the same stability function as the like components of FIG. 3, although inversely positioned as heretofore described.

As described above, the vibration control device of the present invention can allow the air spring in the vibration control device to act smoothly only for the vertical motion of the superstructure separated from the foundation, that is, only the for vertical vibrations, by restricting the horizontal motion of the air spring by the guide portion. Accordingly, the arrangement for allowing the air spring to smoothly move only in a vertical direction by restricting horizontal deflection thereof prevents rocking or like unstable motion due to compound vertical and horizontal movement of the air spring.

The foregoing disclosure and discussion relate to preferred exemplary embodiments of the invention, but it should be understood that other variants and embodiments thereof will become apparent to those skilled in the art upon a reading of the specification taken in conjunction with a study of the attached drawings. Furthermore, it should be understood that such variants and embodiments are possible within the spirit and scope of the invention, as defined by the appended claims.

What is claimed is:

1. In a building having a foundation and a superstructure vertically spaced apart from said foundation, a vertical vibration control device adapted to attenuate vertical vibration in said superstructure comprising: a vertical functioning air spring positioned between said foundation and said superstructure; means to secure said air spring to said superstructure and to said foundation; said vertical vibration control device including a telescoping air spring having an outer cylindrical casing and an inner cylindrical casing adapted to telescopically slide within said outer cylindrical casing, one of said cylinders being relatively vertically shiftable and the other of said cylinders being relatively fixed against vertical movement with respect to said superstructure; vertical guide means, having upper and lower portions, secured on opposite sides of said telescoping air spring; horizontal guide means rigidly secured to one of said cylinders and slidably secured to said vertical guide means, said vertical guide means and said horizontal guide means being adapted to permit said telescoping air spring to vibrate vertically and to restrain said telescoping air spring from shifting horizontally; said vertical guide means including cylindrical shafts having free ends and fixed ends, said horizontal guide means comprising a segmented collar fitted about said outer cylindrical casing, including a horizontal radially extending flange; bearing sleeves fitted in said flange and adapted to receive the free ends of said cylindrical shafts in sliding engagement therethrough; pipe stubs, in like number as said cylindrical shafts, secured to either said foundation or said superstructure, and in vertical concentric alignment with said fixed ends of said corresponding cylindrical shafts; and means to secure said fixed ends of said cylindrical shafts to said pipe stubs.

2. The vertical vibration control device of claim 1, wherein said vertical guide means are integrally secured to said building foundation.

3. The vertical control device of claim 1, wherein said vertical guide means are secured to said superstructure.

4. The vertical vibration control device of claim 1, wherein said outer cylindrical casing is integrally secured to said superstructure and said inner cylindrical casing is integrally secured to said foundation.

5. The vertical vibration control device of claim 1, wherein said outer cylindrical casing is integrally secured to said foundation and said inner cylindrical casing is integrally secured to said superstructure.

6. The vertical vibration control device of claim 1, wherein said vertical guide means are foreshortened to provide clearance between said guide means and said superstructure.

7. The vertical vibration control device of claim 1, wherein said vertical guide means are foreshortened to provide clearance between said guide means and said foundation.

* * * * *